United States Patent [19]

Schieder

[11] Patent Number: 4,911,740

[45] Date of Patent: Mar. 27, 1990

[54] PRESSURE RESPONSIVE VALVE IN A TEMPERATURE CHANGING DEVICE

[76] Inventor: Hans B. Schieder, 3288 Kelton Ave., Los Angeles, Calif. 90034

[21] Appl. No.: 227,190

[22] Filed: Aug. 2, 1988

[51] Int. Cl.[4] ..... F25D 5/00

[52] U.S. Cl. ..... 62/4; 62/294

[58] Field of Search ..... 62/4, 294, 371

[56] References Cited

U.S. PATENT DOCUMENTS

| | | | |
|---|---|---|---|
| 3,229,478 | 1/1966 | Alonso | 62/371 |
| 3,494,141 | 2/1970 | Irwin et al. | 62/294 |
| 3,636,726 | 1/1972 | Rosenfeld et al. | 62/294 |
| 3,881,321 | 5/1975 | Riley | 62/294 |
| 4,319,464 | 2/1982 | Dodd | 62/371 |
| 4,584,848 | 4/1986 | Barnett | 62/294 |
| 4,628,703 | 12/1986 | Kim | 62/294 |
| 4,640,102 | 3/1987 | Tenenbaum et al. | 62/294 |
| 4,669,273 | 6/1987 | Fischer et al. | 62/4 X |
| 4,753,085 | 6/1988 | Labrousse | 62/294 |
| 4,784,678 | 11/1988 | Rudick et al. | 62/4 |
| 4,802,343 | 2/1989 | Rudick et al. | 62/4 X |

FOREIGN PATENT DOCUMENTS 2344048 8/1973 Fed. Rep. of Germany .

*Primary Examiner*—Lloyd L. King

*Attorney, Agent, or Firm*—Knobbe, Martens, Olson & Bear

[57] ABSTRACT

Disclosed is a pressure responsive valve which is opened upon a change in pressure so that there is fluid communicating between a first and second chamber. The valve, though useful in connection with any pressurized container or environment, is shown in conjunction with a self-contained, rapid cooling device that retains heat produced from the cooling process and can be stored for indefinite periods without losing its cooling potential. A liquid in a first chamber undergoes a change of phase into vapor, which cools the first chamber. A sorbent in a second chamber is in fluid communication with the vapor and removes the vapor from the first chamber. The cooling process is facilitated by lining the interior surface of the first chamber with a wicking material to retain the largest possible contact between the liquid and the first chamber as the level of the liquid lowers during the vaporization process. The device is self-contained because a material in contact with the sorbent removes the heat from the sorbent to prevent the reduction in the cooling effect produced by the first chamber.

24 Claims, 1 Drawing Sheet

Fig. 1
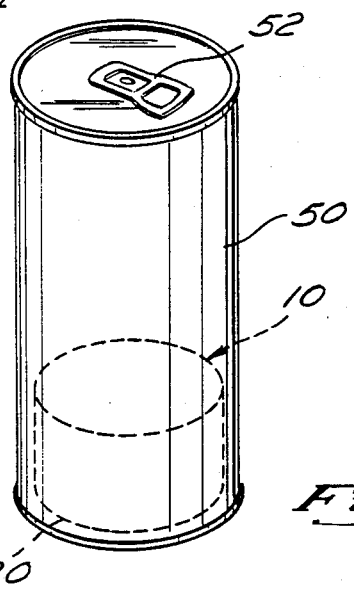
Fig. 2
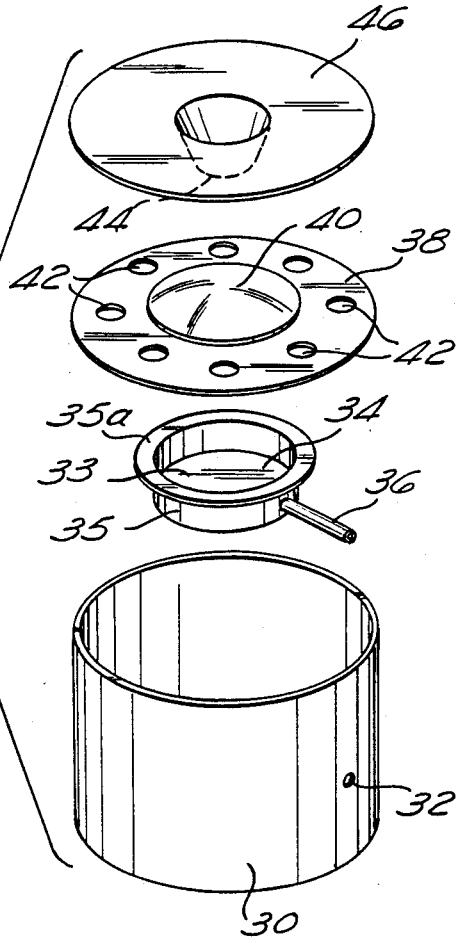
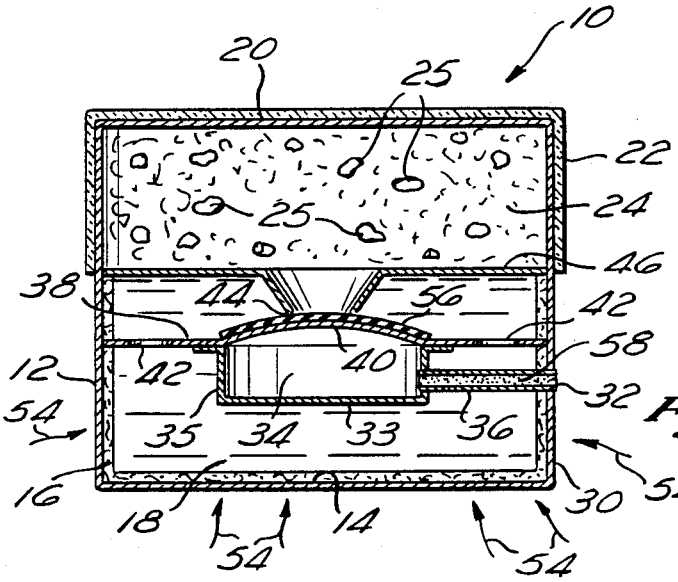
Fig. 3
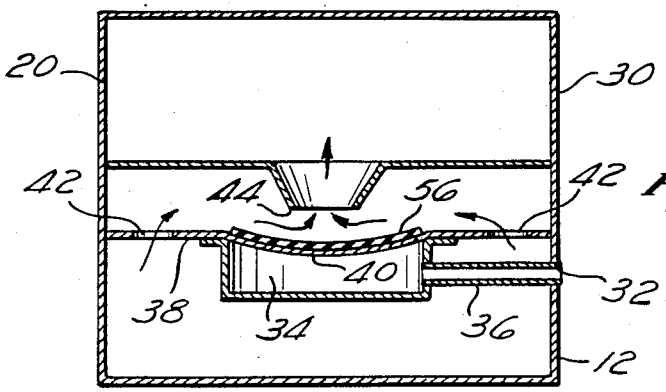
Fig. 4

PRESSURE RESPONSIVE VALVE IN A TEMPERATURE CHANGING DEVICE

BACKGROUND OF THE INVENTION

The present invention relates to temperature changing devices, and, in particular, to portable or disposable beverage coolers which may be activated upon demand by the use of a pressure responsive valve. The disclosed valve is generally applicable in any container, the contents of which is subjected to pressure above or below atmospheric pressure.

As was fully discussed in our two copending applications, the food and beverage industry has been continuously attempting to design an inexpensive, safe, and effective self-contained temperature changing device. Specifically, with regard to the present invention, inventors have been attempting to devise various types of self-contained cooling devices for use in connection with beverage containers, particularly the aluminum can.

There are many beverages that may be stored almost indefinitely at average ambient temperature of 20°—25° C., but that should be cooled immediately before consumption. In general, the cooling of these beverages is accomplished by electrically-run refrigeration units. The use of these units to cool such beverages is not always practical, because refrigerators generally require a source of electricity, they are not usually portable, and they do not cool the beverage quickly.

An alternate method for providing a cooled material on demand is to use portable insulated containers. However, these containers function merely to maintain the previous temperature of the beverage placed inside them, or they require the use of ice cubes to provide the desired cooling effect. When used in conjunction with ice, insulated containers are much more bulky and heavy than he beverage. Moreover, in many locations, ice may not be readily available when the cooling action is required.

Ice cubes have also been used independently to cool beverages rapidly. However, use of ice independently for cooling is often undesirable because ice may be stored only for limited periods above 0° C. Moreover, ice may not be available when the cooling action is desired.

Most attempts to build a self-contained miniaturized cooling device have depended on the use of a refrigerant liquid stored at a pressure above atmospheric pressure, so that the refrigerant vapor could be released directly to the atmosphere. Unfortunately, many available refrigerant liquids for such a system are either flammable, toxic, harmful to the environment, or exist in liquid form at such high pressures that they represent an explosion hazard in quantities suitable for the intended purpose. Conversely, other available refrigerant liquids acceptable for discharge into the atmosphere (such as carbon dioxide) have relatively low heat capacities and latent heats of vaporization. As a result, some cooling devices which release carbon dioxide are more bulky than is commercially acceptable for a portable device.

Our application, Ser. No. 070,973, now U.S. Pat. No. 4,759,191, the contents of which are wholly incorporated herein, discloses the basic concepts underlying the temperature changing device which is used in the present invention. Basically, a cooling effect is produced by the absorption or adsorption of a refrigerant vapor in a chamber separate from the chamber in which the evaporation takes place. In this system, the refrigerant liquid boils under reduced pressure in a sealed chamber and absorbs heat from its surroundings. The vapor generated from the boiling liquid is continuously removed from the first chamber and discharged into a second chamber containing a desiccant or sorbent that absorbs the vapor. Related devices are illustrated in U.S. Pat. No. 4,250,720 to Siegel an Great Britain Patent No. 2,095,386 to Cleghorn, et al.

The prior art discloses numerous disposable beverage containers having various types of self-contained cooling devices therein. For example, see U.S. Pat. Nos. 3,309,890; 3,373,58; 3,494,142; 3,520,148; 3,726,106; and 4,736,599. However, the cooling devices have thus far been unduly complicated and expensive, and consequently no selfcontained refrigeration device has appeared commercially. One reason for the complexity of each of the devices disclosed in the above-cited patents has been the need to construct a mechanism to activate the cooling process upon demand. To accomplish this, the prior art has developed various ways of attaching the cooling device to the fliptop tab portion of the beverage container. Such a construction has compromised the effectiveness of the cooling apparatus a well as has limited the type of cooling devices which can be used. Moreover, the mechanisms take up valuable space within the container so that less beverage can fit within it; alternatively, they require the use of an unduly large container.

It is an object of the present invention to provide a simplified and less expensive method and apparatus for activating a self-contained temperature changing device.

It is another object of the present invention to reduce the complexity of the temperature changing device so that it ay be of a reduced size so that more beverage can be placed inside the container.

It is another object of the present invention to use an improved embodiment of the temperature changing device which will not need to be affixed to any portion of the container so that it may be used in any unmodified industry standard can and in conjunction with all current automated filling equipment.

Other objectives will become apparent from the appended drawing and the following detailed description of the invention.

SUMMARY OF THE INVENTION

The present invention comprises a temperature changing device which is immersed in and capable of operating physically unattached to a pressurized liquid-filled host container or aluminum can. The temperature changing device is a self-contained miniaturized unit having at least two separated chambers, the first containing an evaporant liquid to be adsorbed or absorbed by a sorbent or desiccant and the second being partially evacuated and containing that sorbent or desiccant. Thus, when there is communication between the two chambers, there is a drop in pressure in the first chamber because the second chamber is evacuated. The drop in pressure causes the liquid in the first chamber to vaporize, and because this liquid-to-gas phase change can occur only if the liquid removes heat equal to the latent heat of vaporization of the evaporated liquid from the first chamber, the first chamber cools. Alternatively, the valve disclosed herein may be used in any of the other prior art self cooling pressurized containers, such as beverage cans, containing a reservoir of pressurized gas (like $C0_2$) that is released to cool the contents of the can.

To activate the cooling process, the user merely opens a flip-top tab which releases the pressure from within the beverage container so that a pressure-responsive valve allows communication between the two separated chambers. The present invention uses a valve which comprises a valve seat and a sealed pressurized chamber, a portion of which comprises a flexible diaphragm biased into a first position against the valve seat by the pressure in the chamber, thereby closing the valve. A dissolvable plug is in communication with the pressurized chamber for compromising the seal of the chamber upon the plug's dissolution, after which the diaphragm moves into a second position away from the valve seat upon the release of pressure from the chamber, thereby opening the valve. Thereafter, the evaporant is free to be absorbed by the sorbent or desiccant so that the cooling process can begin.

In a preferred embodiment, the plug is made from a sugar compound. In another, it is made from dissolvable salts or other water soluble material.

In a preferred embodiment, the diaphragm is coated with a resilient sealing agent. Also, it is preferred if the valve seat is of a frusto-conical configuration.

In another preferred embodiment, the diaphragm extends to the sides of the insert so as to affix the diaphragm and the pressurized chamber relative to the housing of the temperature changing device. The outer portion o the diaphragm has a plurality of evenly spaced bypass holes for the passage of the evaporant through the valve seat and to the desiccant chamber.

Though a valve is disclosed in conjunction with a temperature changing device, it is understood that it can be applied to any container whose contents is different from atmospheric pressure, including evacuated chambers. Moreover, because the device need not be physically attached to the host container, it is understood that the present invention can be used in any type of container, not just a beverage can.

DESCRIPTION OF THE DRAWINGS

FIG. 1 is a perspective view of a beverage container within which is disposed the temperature changing device shown in phantom.

FIG. 2 is an exploded view of the temperature changing device employing the valve of the present invention.

FIG. 3 is a cross-sectional view of the temperature changing device employing the valve of the present invention wherein the diaphragm is n the closed position.

FIG. 4 is a cross-sectional view of the present invention showing the diaphragm in the opened position.

DETAILED DESCRIPTION OF THE PREFERRED EMBODIMENT

The host container or beverage container 50 is illustrated in FIG. 1. As with most beverage containers used today, the illustrated container is an aluminum can such as is commonly used to contain a beverage, such as beer, soda, seltzer water, or any other pressurized or carbonated liquid drink. The can uses a flip-top or releasable tab 52 which is flipped or pulled off when the user desires to consume the container's contents. When the tab is pulled, the pressure from within the container is released to the atmosphere through an opening in the top of the container (not shown). Through that opening the beverage exits the container.

Within the container, a temperature changing device 10 is shown. The device is shown as having a cylindrical configuration, although it is understood that it may be of any suitable shapes as long as the contact with the beverage is substantial. That is, the cooling effect is maximized if the beverage comes into much direct contact with the surface area of the cooling portion of the temperature changing device.

FIG. 2 illustrates the basic components of the temperature changing device as adapted for use in the present invention. FIG. 3 depicts the device fully assembled and ready to be activated.

As shown in FIG. 3, one preferred cooling device 10 has a first chamber 12 lined on the interior surface 14 with a wicking material 16, which in a preferred embodiment could be accomplished by flocking or spraying the interior surface 14 with the wicking material 16. The first chamber 12 is filled with a refrigerant liquid 18. The cooling device 10 also includes a second chamber 20 which is at least partially filled with a sorbent 24 in contact with a heat removing material 25. It is preferred that the second chamber 20 be surrounded by a thermal insulator 22. The second chamber 20 is initially evacuated, and the first chamber 12 may also advantageously be evacuated to the extent that it contains only the vapor of the refrigerant liquid. Connecting the first and second chambers 12 and 20 is the passageway formed upon the opening of the pressure responsive valve as disclosed in the present invention and as depicted in FIG. 4.

The device 10 is constructed of housing 30 which may be of any shape which maximizes its contact with the beverage to be cooled. The housing 30 has at least one orifice 32 through which gas may exit from the pressurized chamber 34. Placed within the housing 30 is the pressurized chamber 34 out of which a tube 36 protrudes. The pressurized chamber 34 is constructed from a circular flooring 33 upon which is attached an annular ring 35 having a radially extending flange **35*a*. The tube 36 extends to the orifice 32 and is of a length sufficient to allow fluid communication between the interior of the pressurized chamber 34 and the exterior of the housing 30**.

The figures show that the upper portion of the pressurized chamber 34 is formed by a flexible diaphragm 38 made of a deflection resistant material, preferably spring steel. If the diaphragm 38 were viewed in top plan, it preferably would be circular, having a concentric inner circle 40 which would not lie in the same horizontal plane as the outer portion of diaphragm 38. That is, when the inner portion 40 of diaphragm 38 is view in cross section in any vertical plane, it appears partially spherical. FIGS. 2–4 illustrate the center inner circle 40 of diaphragm 38 as a smaller semi-spherical bubble. Only that center portion 40 of the diaphragm 38 assumes a second position as will be discussed.

In a preferred embodiment, the center portion of the diaphragm 38 is coated with a resilient sealing agent 56 to seal more effectively the chambers containing the evaporator 18 and the desiccant 24. Suitable materials for the sealing agent 56 include natural and synthetic rubber, silicone, polytetrafluoroethylene, and other elastomers and polymers capable of forming a seal against the valve seat 44.

Preferably, the diaphragm 38 has a diameter equal to the interior diameter of housing 30 an rests on the annular ring 35. Thus, the diaphragm 38 is affixed to ring 35 to form a completed chamber 34 which is capable of containing pressure therein. Moreover, the outer edge of the diaphragm 38 will be adjacent to the interior walls of housing 30 to rigidly hold the chamber 34 relative to the housing 30. The outer portion of diaphragm 38 will have a plurality of bypass holes 42, which will allow the fluid communication between first chamber 12 containing the evaporator 18 and second chamber 20 containing desiccant 24 when the valve is opened.

Positioned above the diaphragm 38 is the valve seat 44 which is preferably of a frusto-conical configuration, preferably with the more narrow end flushed against diaphragm 38 when the diaphragm is in its initial position. Radiating circumferentially from the upper wider end of the valve seat is partition 46. In combination with the valve seat 44 positioned against the upper side of diaphragm 38, partition 46 separates the second chamber 20 and the first chamber 12.

As illustrated in FIG. 3, in its fully assembled condition, the pressure in the pressurized chamber 34 exerts a force against the underside of diaphragm 38 causing the center portion 40 of the diaphragm 38 to be convexly positioned against the lowermost portion of valve seat 44. FIGS. 3 and 4 show the resilient sealing agent 56 placed o the center portion 40 of the diaphragm 38 and thus between the diaphragm 38 and the valve seat 44. The pressure in pressurized chamber 34 need not be any greater than that required to deform center portion 40 of the diaphragm 38 to its convex position. In that position, the edges of the lowermost portion of valve seat 44 cut into the sealing agent 56 to form an airtight seal.

Pressure is initially maintained with the pressurized chamber 34 by the placement of a plug 58 within tube 36 so that no gas can escape through the tube 36. The plug 58 is made of any liquid dissolving material, such as any sugar compound or a water dissolvable salt or other water soluble (non-toxic) material, so that upon the placement of the entire device 10 within a beverage-filled container 50, the beverage (not shown) will begin to dissolve the plug 58. The can is then sealed in a conventional manner before the plug 58 i completely dissolved. At that point, because the beverage itself is under pressure, the pressure within the pressurized chamber 34 is not released and thus the outer portion 40 of diaphragm 38 will remain in its initial position.

Preferably, the cooling devices 10 are dropped into standard unmodified cans 50 just prior to the introduction of the beverage. After introducing the beverage, the can 50 is sealed. As a result of the filling process, a substantial pressure is generated in each can 50, both as a byproduct of the agitation of freshly carbonated beverage and the introduction of carbon dioxide in a pre-seal purge cycle. The pressure within the container 50 is generally greater than the pressure within pressure chamber 34, but is always at least great enough to maintain the outer portion 40 of the diaphragm 38 in its initial position against the value seat 44. Thus, though the plug 58 dissolves, the pressure with the container 50 will retain the seal by exerting force on the underside of diaphragm 38. The beverage-filled container 50 can now be stored indefinitely until consumption.

It is not until the pressure existing in the entire beverage container 50 is released that the cooling process begins. Upon the release of tab 52, the pressure with the beverage container 50 is released, and simultaneously therewith, the pressure from within the pressurized chamber 34 is also released. That release of pressure causes the flexible diaphragm 38 to go into its relaxed concave or second position, as depicted in FIG. 4. The elasticity of the diaphragm overcomes the vacuum of the second chamber 20. This return to the relaxed position of diaphragm 38 allows fluid communication through bypass holes 42 between the first and second chambers, 12 and 20, causing a drop in pressure in chamber 12 because the second chamber 20 is evacuated. The drop in pressure in the first chamber 12, upon the opening of the can 50 and thus the pressure responsive valve, causes the liquid 18 to boil at ambient temperature into a liquid-vapor mixture. This liquid-to-gas phase change can occur only if the liquid 18 removes heat equal to the latent heat of vaporization of the evaporated liquid 18 from the first chamber 12. This causes the first chamber 12 to cool. The cooled first chamber 12, in turn, removes heat from its surrounding material as indicated by the arrows 54. As a result, the beverage surrounding housing 30 will get cooled and is ready for consumption.

During the vaporization process, the level of the liquid 18 in the first chamber 12 drops. The wicking material 16 retains the liquid 18 on the interior surface 14 of the first chamber 12 to prevent a reduction in the area of contact between the liquid 18 and the interior surface 14, which would cause a reduction in the effective heat transfer surface area of the first chamber 12 and would thus slow the cooling process.

When the sorbent 24 absorbs or absorbs the vapor, a heat of absorption or adsorption is generated. A heat-removing material 25 which is thermally coupled to the sorbent 24 (and preferably is mixed with the sorbent 24) may optionally be used to remove heat from the sorbent 24, preventing or slowing a rise in temperature in both sorbent 24 and chamber 20, which rise in temperature might compromise the cooling effect produced by chamber 12.

Two important components of the cooling device are the evaporating liquid and the sorbent. The liquid and the sorbent must be complimentary (i.e., the sorbent must be capable of absorbing or adsorbing the vapor produced by the liquid), and suitable choices for these components would be any combination able to make a useful change in temperature in a short time, meet government standards for safety, and be compact.

The refrigerant liquids used in the present invention preferably have a high vapor pressure at ambient temperature, so that a reduction of pressure will produce a high vapor production rate. The vapor pressure of the liquid at 20°C. is preferably at least about 9 mm Hg, and more preferably is at least about 15 or 20 mm Hg. Moreover, for some applications (such as cooling of food products), the liquid should conform to applicable government standards in case any discharge into the surroundings, accidental or otherwise, occurs. Liquids with suitable characteristics for various uses of the invention include: various alcohols, such as methyl alcohol and ethyl alcohol; ketones or aldehydes, such as acetone and acetaldehyde; water; and freons, such as freon C318, 114, 21, 11, 114B2, 113, and 112. The preferred liquid is water.

In addition, the refrigerant liquid may be mixed with an effective quantity of a miscible nucleating agent having a greater vapor pressure than the liquid to promote ebullition so that the liquid evaporates even more quickly and smoothly, and so that supercooling of the liquid does not occur. Suitable nucleating agents include ethyl alcohol, acetone, methyl alcohol, propyl alcohol and isobutyl alcohol, all of which are miscible with water. For example, a combination of a nucleating agent with a compatible liquid might be a combination of 5% ethyl alcohol in water or 5% acetone in methyl alcohol. The nucleating agent preferably has a vapor pressure at 25°C. of at least about 25 mm Hg and, more preferably, at least about 35 mm Hg. Alteratively, solid nucleating agents may be used, such as the conventional boiling stones used in chemical laboratory application.

The sorbent material used in the second chamber 20 is preferably capable of absorbing and adsorbing all the vapor produced by the liquid, and also preferably will meet government safety standards for use in an environment where contact with food may occur. Suitable sorbents for various applications may include barium oxide, magnesium perchlorate, calcium sulfate, calcium oxide, activated carbon, calcium chloride, glycerine, silica gel, alumina gel, calcium hydride, phosphoric anhydride, phosphoric acid, potassium hydroxide, sulphuric acid, lithium chloride, ethylene glycol and sodium sulfate.

The heat-removing material may be one of three types: (1) a material that undergoes a change of phase when heat is applied; (2) a material that has a heat capacity greater than the sorbent; or (3) a material that undergoes an endothermic reaction when brought in contact with the liquid refrigerant.

Suitable phase change materials for particular applications may be selected from paraffin, naphthalene sulphur, hydrated calcium chloride, bromocamphor, cetyl alcohol, cyanamide, eleudic acid, lauric acid, hydrated sodium silicate, sodium thiosulfate pentahydrate, disodium phosphate, hydrated sodium carbonate, hydrated calcium nitrate, Glauber's salt, potassium, sodium and magnesium acetate. The phase change materials remove some of the heat from the sorbent material simply through storage of sensible heat. In other words, they heat up as the sorbent heats up, removing heat from the sorbent. However, the most effective function of the phase change material is in the phase change itself. An extremely large quantity of heat can be absorbed by a suitable phase change material in connection with the phase change (i.e., change from a solid phase to a liquid phase, or change from a liquid phase to a vapor phase). There is typically no change in the temperature of the phase change material during the phase change, despite the relatively substantial amount of heat required to effect the change, which heat is absorbed during the change. Phase change materials which change from a solid to a liquid, absorbing from the sorbent their latent heat of fusion, are the most practical in a closed system. However, a phase change material changing from a liquid to a vapor is also feasible. Thus, an environmentally-safe liquid could be provided in a separate container (not shown) in contact with the sorbent material (to absorb heat therefrom) but vented in such a way that the boiling phase change material carries heat away from the sorbent material and entirely out of the system.

Another requirement of any of the phase change materials is that they change phase at a temperature greater than the expected ambient temperature of the material to be cooled, but less than the temperature achieved by the sorbent material upon absorption of a substantial fraction (i.e., one-third or one-quarter) of the refrigerant liquid. Thus, for example, in most devices according to the present invention which are intended for use in cooling a material such as a food or beverage, the phase change material could change phase at a temperature above about 30° C., preferably above about 35° C. but preferably below about 70° C., and most preferably below about 60° C. Of course, in some applications, substantially higher or lower phase change temperatures may be desirable. Indeed, many phase change materials with phase change temperatures as high as 90° C., 100° C. or 110° C. may be appropriate in certain systems.

Materials that have a heat capacity greater than that of the sorbent simply provide a thermal mass in contact with the sorbent that does not effect the total amount of heat in the system, but reduces the temperature differential between the material being cooled and the second chamber 20, with two results. First, the higher the temperature gradient between two adjacent materials, the more rapid the rate of heat exchange between those two materials, all else being equal. Thus, such thermal mass materials in the second chamber 20 slow the transfer of heat out of the second chamber 20. Second, many sorbent materials function poorly or do not function at all when the temperature of those materials exceeds a certain limit. Heat-absorbing material in the form of a thermal mass can substantially reduce the rate of the sorbent's temperature increase during the cooling cycle. This, in turn, maintains the sorbent at a lower temperature and facilitates the vapor-sorption capabilities of the sorbent. Various materials which have a high specific heat include cyanamide, ethyl alcohol, ethyl ether, glycerol, isoamyl alcohol, isobutyl alcohol, lithium hydride, methyl alcohol, sodium acetate, water, ethylene glycol and paraffin wax.

Care must be taken, of course, when selecting a high specific heat material (or high thermal mass material) to ensure that it does not interfere with the functioning of the sorbent. If the heat-absorbing material, for example, is a liquid, it may be necessary to package that liquid or otherwise prevent physical contact between the heat-absorbing material and the sorbent. Small individual containers of heat-absorbing material scattered throughout the sorbent may be utilized when the sorbent and the heat-absorbing material cannot contact one another. Alternatively, the heat-absorbing material may be placed in a single package having a relatively high surface area in contact with the sorbent to facilitate heat transfer from the sorbent into the heat-absorbing material.

The third category of heat-removing material (material that undergoes an endothermic reaction) has the advantage of completely removing heat from the system and storing it in the form of a chemical change. The endothermic material may advantageously be a material that undergoes an endothermic reaction when it comes in contact with the refrigerant liquid (or vapor). In this embodiment of the invention, when the valve 30 in the conduit 28 is opened, permitting vapor to flow through the conduit 28 into the second chamber 20, the vapor comes in contact with some of the endothermic material, which then undergoes an endothermic reaction, removing heat from the sorbent 24. Such endothermic materials have the advantage that the heat is more or less permanently removed from the sorbent, and little, if any, of that heat can be retransferred to the material being cooled. This is in contrast to phase change materials and materials having a heat capacity greater than the sorbent material, both of which may eventually give up their stored heat to the surrounding materials, although such heat exchange (because of the insulation 22 or because of other design factors that retard heat transfer, such as poor thermal conductivity of the sorbent 24) generally does not occur with sufficient rapidity to reheat the cooled material prior to use of that material.

Heat-absorbing materials which undergo an endothermic reaction may variously be selected from such compounds as $H_2B0_3$, $PbBr_2$, $KBr0_3$, $KC10_3$, $K_2Cr_20_7$, $KC10_4$, $K_2S$, $SnI_2$, $NH_4Cl$, $KMn0_4$ and $CsC10_4$. Furthermore, the heat-removing material may be advantageously in contact with the sorbent. In various embodiments of the invention, the sorbent and heat-removing material could be blended, the heat-removing material could be in discrete pieces mixed with the sorbent, or the material could be a mass in contact with, but not mixed into, the sorbent.

In selecting the wicking material 16, any of a number of materials may be chosen, depending upon the requirements of the system and the particular refrigerant liquid 18 being used. The wicking material may be something as simple as cloth or fabric having an affinity for the refrigerant liquid 18 and a substantial wicking ability. Thus, for example, when the refrigerant liquid is water, the wicking material may be cloth, sheets, felt or flocking material, which may be comprised of cotton, filter material, natural cellulose, regenerated cellulose, cellulose derivatives, blotting paper, or any other suitable material.

The most preferred wicking materials are the highly hydrophilic materials, such as gel-forming polymers and water wicking polymers. Those polymers include vinylchloride acetate, vinylidene chloride, tetrafluoroethylene, methyl methacrylate, hexanedoic acid, dihydro-2, 5-furandione, propenoic acid, 1, 3-isobenzofurandione, 1 h-pyrrole-2, 5-dione, and hexahydro-2 h-azepin-2-one.

The thermal insulator 22 may be any conventional insulation material, but is preferably an inexpensive, easily-formed material such as a low-cost polystyrene foam.

The invention also includes a method of using the cooling device described herein. This method includes the step of providing a cooling device of the type set forth herein; opening the valve between the first chamber 12 and the second chamber 20 by releasing the pressure in the host container 50, whereby the pressure in the first chamber is reduced, causing the liquid to boil, forming a vapor, which vapor is collected by the sorbent material; removing vapor from the second chamber by collecting the same in the sorbent until an equilibrium condition is reached wherein the sorbent is substantially saturated or substantially all of the liquid originally in the first chamber has been collected in the sorbent; and optionally simultaneously removing heat from the sorbent by means of the heat-removing material described above. The process is preferably a one-shot process; thus, opening of the pressure response valve is preferably irreversible. At the same time, the system is a closed system; in other words, the refrigerant liquid does not escape the system, and there is no means whereby the refrigerant liquid or the sorbent may escape either the first chamber 12 or the second chamber 20. Only the gas from the pressurized chamber 34 and the gas from the beverage container 50 escapes to the atmosphere.

Although the invention has been described in the context of certain preferred embodiments, it is intended that the scope of the invention not be limited to the specific embodiment set forth herein, but instead be measured by the claims that follow.

WHAT IS CLAIMED:

1. A valve for use in a pressurized container comprising;

a valve seat;

a sealed pressurized chamber, a portion of which comprises diaphragm biased into a first position against said seat by the pressure in said chamber, thereby closing said valve; and a dissolvable plug in communication with said chamber, for compromising the seal of said chamber upon dissolution of said plug, said diaphragm adapted to move into a second position away from said seat upon release of pressure from said chamber thereby opening said valve.

2. The valve of claim 1, wherein the plug is dissolvable in aqueous liquid.

3. The valve of claim 2, wherein the plug comprises a sugar compound.

4. The valve of claim 2, wherein the plug is comprised of water soluble salts.

5. The valve of claim 1, wherein said diaphragm is made from deflection resistant material.

6. The valve of claim 4, wherein said diaphragm is made of spring steel.

7. The valve of claim 5, wherein said diaphragm has a substantially concentric circle deformed from a flat condition so that when said diaphragm is viewed in cross section, said circle would appear partially spherical.

8. The valve of claim 1, wherein said diaphragm is coated with a resilient sealing agent proximate to said valve seat.

9. The valve of claim 8, wherein said sealing agent is made from material selected from the group consisting of natural rubber, synthetic rubber, silicone, polytetrafluoroethylene, polyurethane, elastomers, and other polymers capable of forming a seal against said valve seat.

10. A self-contained cooling apparatus in a pressurized container, comprising:

a first chamber containing a vaporizable liquid;

a second evacuated chamber containing a sorbent for said liquid;

a pressure-responsive valve having a diaphragm pressing against a seat to close said valve, which opens upon the release of pressure from said container when said diaphragm moves away from said seat in response to said pressure release, thereby establishing fluid communication between said first and second chambers, permitting said liquid to vaporize and permitting said vapor to pass into said sorbent, whereby the evaporation of said liquid serves to cool said first chamber.

11. A self-contained cooling apparatus in a pressurized container, comprising:

a first chamber containing a vaporizable liquid;

a second evacuated chamber containing a sorbent for said liquid;

a pressure-responsive valve which opens upon the release of pressure from said container, thereby establishing fluid communication between said first and second chambers, permitting said liquid to vaporize and permitting said vapor to pass into said sorbent, whereby the evaporation of said liquid serves to cool said first chamber, said valve comprising a valve seat positioned between the first and second chambers;

a pressurized third chamber proximate to said valve seat;

a flexible diaphragm forming a wall of said third chamber and expanded outward by the pressure in said third chamber against the valve seat so that said diaphragm seals the valve seat to close said valve;

a duct between said pressurized chamber and the host container; and a soluble plug in said duct for maintaining pressure within said pressurized third chamber while the temperature changing device is being immersed in the host container so that said diaphragm remains in an expanded form, said plug capable of dissolving once in the pressurized host container so that upon the release of the pressure from the host container, the pressure from said pressurized chamber is released through said duct and host container causing said diaphragm to move away from said valve seat, thereby opening said valve and allowing the liquid to evaporate and pass through said valve seat into the sorbent.

12. A method for cooling, comprising the steps of:

(a) providing, in a pressurized container, a cooling device comprising:

(i) a first chamber containing a vaporizable liquid;

(ii) a second evacuated chamber containing a sorbent for said liquid;

(iii) a pressure responsive valve preventing communication between said first chamber and said second chamber while said valve is closed; and (iv) means for opening said valve to connect said first and second chamber;

(b) releasing the pressure from said container, thereby opening said valve to permit communication between said first chamber and said second chamber, whereby the pressure in said first chamber is reduced, causing said liquid to boil, forming a vapor, which vapor is directed through said valve into said second chamber; and (c) removing vapor from said second chamber by collecting same in said sorbent until and equilibrium condition is reached, wherein said sorbent is substantially saturated or substantially all of the liquid originally in said first chamber has been collected in said second chamber.

13. The method of claim 12, wherein the means for opening said valve is a pressure releasing flip-top tab on said container.

14. The method of claim 13, wherein the step of opening said valve comprises moving said flip-top tab.

15. The apparatus of claim 10, wherein said vaporizable liquid has a vapor pressure at 20° C. of above about 9 mm Hg.

16. The apparatus of claim 10, wherein said vaporizable liquid is water.

17. The apparatus of claim 1 or 11, wherein said valve seat is of a frusto-conical configuration.

18. The method of claim 12, wherein said valve comprises:

a valve seat;

a sealed pressurized chamber, a portion of which comprises a diaphragm biased into a first position against said seat by the pressure in said chamber, thereby closing said valve; and a dissolvable plug in communication with said chamber, for compromising the seal of said chamber upon dissolution of said barrier, said diaphragm adapted to move into a second position away from said seat upon release of pressure from said chamber thereby opening said valve.

19. The method of claim 18, wherein said plug consists of a sugar compound or a water soluble salt.

20. The method of Claim 18, wherein said diaphragm is made from deflection-resistant material.

21. The method of Claim 20, wherein said diaphragm is made of spring steel.

22. The method of Claim 20, wherein said diaphragm has a substantially concentric circle deformed from a flat condition so that when said diaphragm is viewed in cross section, said circle would appear partially spherical.

23. The method of Claim 18, wherein said diaphragm is coated with a resilient sealing agent proximate to said valve seat.

24. The method of Claim 23, wherein said sealing agent is made from material selected from the group consisting of natural rubber, synthetic rubber, silicone, polytetrafluoroethylene, elastomers, and other polymers capable of forming a seal against said valve seat.

* * * * *